US006000587A

United States Patent [19]

Sackett et al.

[11] Patent Number: 6,000,587

[45] **Date of Patent: *Dec. 14, 1999**

[54] CLOTHES HANGER HAVING STORABLE HOOK

[76] Inventors: Eleanor L. Sackett, 114 Third Ave., Southeast, Stewartville, Minn. 55976; Gary F. Krofchalk, 2341 Driftwood Dr., Apt. 214, Mesquite, Tex. 75150

[ * ] Notice: This patent is subject to a terminal disclaimer.

[21] Appl. No.: 08/834,226

[22] Filed: Apr. 15, 1997

Related U.S. Application Data

[63] Continuation-in-part of application No. 08/601,299, Feb. 16, 1996, Pat. No. 5,649,652.

[51] Int. Cl.[6] ..... A47G 25/38; A47G 25/14

[52] U.S. Cl. ..... 223/85; 223/94; 223/DIG. 4

[58] Field of Search ..... 223/85, 92, 88, 223/DIG. 4, 89, 94; D6/315

[56] References Cited

U.S. PATENT DOCUMENTS

| | | | |
|---|---|---|---|
| D. 210,259 | 2/1968 | Holtzman . | |
| 1,551,769 | 9/1925 | Paddington . | |
| 2,077,251 | 4/1937 | Moore . | |
| 2,428,820 | 10/1947 | Therrien . | |
| 2,465,576 | 3/1949 | Colburn . | |
| 2,503,367 | 4/1950 | Weckstein | 223/92 |
| 2,701,082 | 2/1955 | Cohen . | |
| 3,860,154 | 1/1975 | Atkins . | |
| 3,963,154 | 6/1976 | Schwartz et al. . | |
| 4,029,239 | 6/1977 | Dolan . | |
| 4,063,670 | 12/1977 | Faarbech | 223/92 |
| 4,074,838 | 2/1978 | Blasnik et al. . | |
| 4,624,396 | 11/1986 | Universe | 223/92 |
| 4,728,016 | 3/1988 | McPhee . | |
| 4,885,920 | 12/1989 | Larson . | |
| 5,074,445 | 12/1991 | Chen . | |
| 5,085,357 | 2/1992 | Chen | 223/89 |
| 5,137,191 | 8/1992 | Blanchard et al. . | |
| 5,328,068 | 7/1994 | Shannon . | |
| 5,649,652 | 7/1997 | Sackett et al. | 223/DIG. 4 |

*Primary Examiner*—Bibhu Mohanty
*Attorney, Agent, or Firm*—Haynes and Boone, LLP

[57] ABSTRACT

A clothes hanger with a storable hook provides convenient suspension of a garment therefrom without being limited as to length by a neck opening of the garment. In a preferred embodiment, a clothes hanger has a hook portion which is rotatable relative to a body portion, and which is pivotably storable in the body portion. The body portion is hollow and includes two sides which, when joined together, permit both rotatable and pivotable attachment of the hook portion to the body portion and form an opening through which the hook portion may be inserted into the body portion.

20 Claims, 6 Drawing Sheets

CLOTHES HANGER HAVING STORABLE HOOK

CROSS REFERENCE TO RELATED APPLICATION

This application is a Continuation-in-Part of U.S. patent application Ser. No. 08/601,299, filed Feb. 16, 1996 now U.S. Pat. No. 5,649,652, entitled "Clothes Hanger having Storable Hook", and hereby incorporated as if reproduced in its entirety.

BACKGROUND OF THE INVENTION

1. Field of the Invention

The present invention relates generally to clothes hangers and, more particularly, to a clothes hanger having a storable hook.

2. Description of Related Art

Many garments, such as sweaters and other knitted clothes, will take on the shape of the clothes hangers from which they are suspended. This problem is particularly acute when clothes hangers are short and thin, and is evidenced by "points" on the shoulder areas of the garments after being suspended from these hangers. To overcome this deficiency, a number of "wide body" clothes hangers, typically formed of either wood or plastic, characterized by an increased length and/or a widened surface area from which the garment is suspended have been developed.

A conventional wide body clothes hanger is typically inserted through a neck opening of a garment and into shoulder areas thereof. The garment is then suspended from the hanger with the hanger extending between the shoulder areas and a hook portion of the hanger extending upwardly through the neck opening. For this reason, such clothes hangers are often shaped so that they resemble human shoulders.

Most clothes hangers have hooks which have a fixed position. Such a hook is typically aligned with the hanger body and is effective, for example, in hanging the garment on a rod in a closet. With the hook positioned centrally between the hanger's shoulder portions, the neck opening of the garment limits the length of the hanger's shoulder portions, since each of the shoulder portions must be inserted through the neck opening.

A problem is experienced when clothes hangers are used to hang crew neck sweaters or clothes having non-expandable neck openings. To hang the clothes, the hanger is held at an angle and a first end inserted through the neck opening and into one shoulder area of the garment until the hook stops forward movement of the hanger. The second end is then inserted into the other shoulder area. However, to fit the second end through the neck opening, the neck opening often has to be expanded. For buttoned shirts and other clothes having expandable neck openings, this is not a problem. For crew neck sweaters, the neck opening has to be undesirably stretched, and for clothes with non-expandable neck openings, it cannot be done. If the hook was storable, the reduced clearance needed for insertion of the hanger would allow the entire hanger to be inserted into the neck opening, thereby eliminating the need to stretch the neck opening.

Some people prefer to hang clothes by inserting the hanger into the opening at the bottom of the garment and bringing it up to the shoulder areas. Again, the presence of the hook makes this type of hanging difficult because of the ease with which the hook is snagged on the clothes. Again, a storable hook would eliminate this problem.

The hook also makes hangers very difficult to store or to pack in suitcases. A storable hook would make the task of storing hangers much easier.

Some clothes hangers are known in the art which have hooks that are not rigidly fixed. For example, the following U.S. patents disclose hangers having hooks which rotate about an axis longitudinally aligned with the hangers' shoulder portions: U.S. Pat. No. 2,428,820 to Therrien, U.S. Pat. No. 1,551,769 to Paddington, and U.S. Pat. No. 3,860,154 to Atkins. The following U.S. patents disclose hangers having hooks which rotate about a vertical axis: U.S. Pat. No. 4,074,838 to Blasnik et al., U.S. Pat. No. 3,963,154 to Schwartz et al., U.S. Pat. No. 5,074,445 to Chen, and U.S. Pat. No. 2,465,576 to Colburn. The following U.S. patents disclose hangers having hooks which rotate about a horizontal axis orthogonal to the hangers' shoulder portions: U.S. Pat. No. 2,701,082 to Cohen, U.S. Pat. No. 5,074,445 to Chen, and U.S. Pat. No. D210,259 to Holtzman.

Hook rotation about the vertical axis enables a clothes hanger to be hooked over a surface which is aligned with the hanger shoulder portions, such as a door or back of a chair, permitting the garment to lay flat adjacent the door or chair back, etc. Hook rotation about a horizontal axis enables the hook to be stored proximate the hanger's body portion.

From the foregoing, it can be seen that it would be quite desirable to provide a clothes hanger which has a length which is not limited by the garment's neck opening, but which has relatively long and smoothly contoured shoulder portions. It would also be quite desirable to provide a clothes hanger having a hook which is rotatable about a vertical and a horizontal axis. It is accordingly an object of the present invention to provide such a clothes hanger.

SUMMARY OF THE INVENTION

In carrying out the principles of the present invention, in accordance with an embodiment thereof, a clothes hanger is provided which is a relatively long, hollow, and curved cylinder, and a storable and pivotable hook, utilization of which aids in eliminating the problems of misshapen garments caused by short, thin hangers, problems associated with stretching neck openings of clothes, and storing such hangers. The hook of the clothes hanger is storable within the body of the hanger.

In broad terms, a clothes hanger is provided which includes a hook portion and a body portion. The hook portion has a hook, a spherical end, and a shaft extending between the hook and the spherical end. The body portion includes two sides, each of the sides having an interior surface and a seat formed on the interior surface. The sides are joined together with the spherical end captively retained between the seats, such that the hook portion is rotatable about a vertical axis and pivotable about a horizontal axis relative to the body portion. An opening formed between the sides is capable of receiving the hook portion therein, such that the hook portion is storable in the opening.

The use of the disclosed clothes hanger permits garments, such as sweaters, to be suspended without causing "points" in the garments' shoulder areas. The clothes hanger is also versatile in that it has a hook which both rotates and pivots.

BRIEF DESCRIPTION OF THE DRAWING

The invention will be better understood and its numerous objects and advantages will become apparent to those skilled in the art by reference to the following drawing in which.

DETAILED DESCRIPTION

Figure 1:
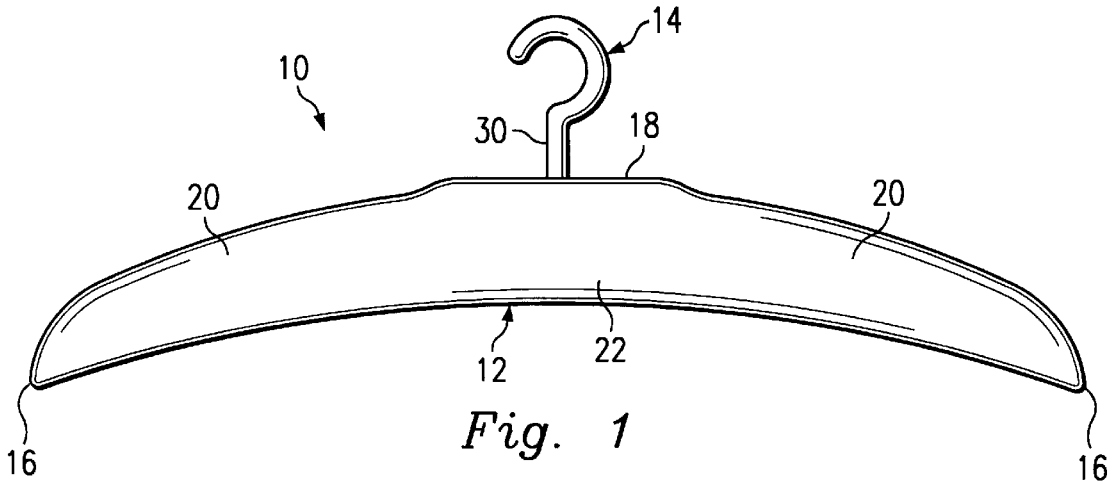
FIG. 1 is a side elevational view of a clothes hanger constructed in accordance with the teachings of the present invention.

In the following detailed description, directional terms, such as "upwardly", "downwardly", "horizontal", and "vertical", refer to the invention as shown in the accompanying drawings. It is to be understood that the present invention is operative in orientations other than those shown in the drawings.

Illustrated in FIGS. 1–3B is a clothes hanger 10 which embodies principles of the present invention. The clothes hanger 10 includes a body portion 12 and a hook portion 14. The hook portion 14 is disposed midway between opposite ends 16 of the body portion 12. The hanger 10 has a length between the hook portion 14 and each opposite end 16 which is not limited by the length of a garment's neck opening, as will be readily understood by consideration of the following description.

Figure 1A:
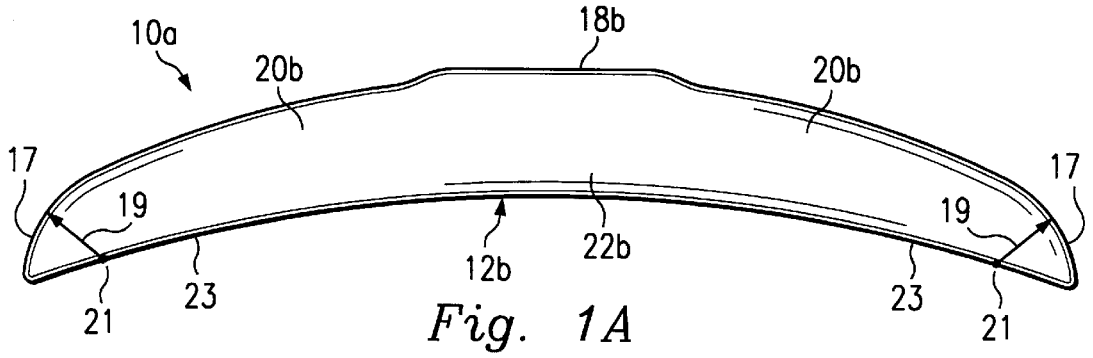
FIG. 1A is a side elevational view of an alternate embodiment of a clothes hanger constructed in accordance with the teachings of the present invention.

Alternate opposite ends 17 are shown in FIG. 1A, wherein another version of the clothes hanger 10*a* having elements of the previously described clothes hanger 10 which perform similar functions identified with the same reference numeral, but with an added suffix "b". Ends 17 provide a larger upwardly facing radius 19 from which to suspend garments, as compared to ends 16 of hanger 10. To achieve a maximum length radius, radius 19 preferably has a center point 21 at or near a lower surface 23 of the body 12*a*. Thus, ends 17 act to further prevent bulges in shoulder areas of garments suspended therefrom.

Returning now to the description of the hanger 10, the body portion 12 is a generally cylindrical member which is hollow and has spherical opposite ends 16. The body portion 12 has a curved shape, opening concavely downward. A central neck portion 18 extends upwardly from the body portion 12. Shoulder portions 20 extend outwardly from the neck portion 18. When operatively installed into the garment, the neck portion 18 will extend upwardly through the garment's neck opening and the shoulder portions 20 will extend into the shoulder areas of the garment.

Figure 3A:
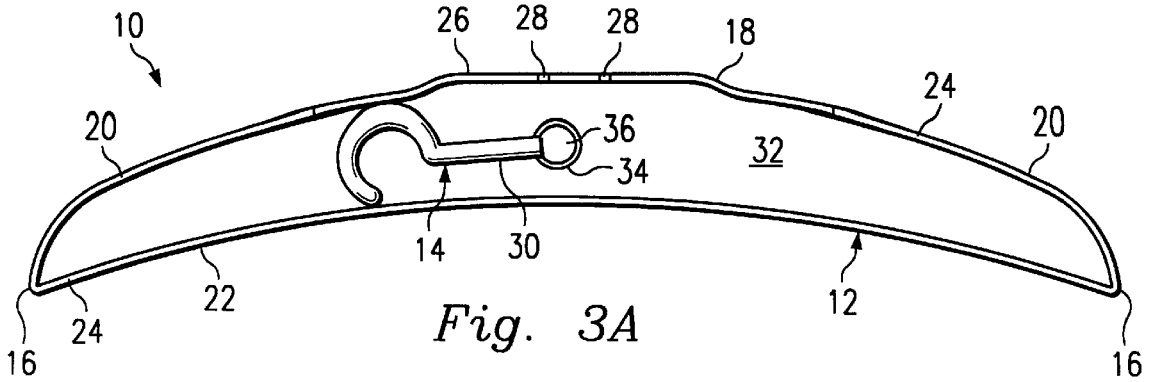
FIG. 3A is a side elevational view of the clothes hanger of FIGS. 1–2 with a body side removed to reveal the hook portion thereof pivoted about a horizontal axis into a stored position.

The shoulder portions 20 are relatively long and, thus, provide a larger supporting area on which to suspend the garment. The lengths of the shoulder portions 20 are not limited by the size of the garment's neck opening due to the unique manner in which the hook portion 14 may be pivoted and stored within the body portion 12 as shown in FIG. 3A. The hook portion 14 may be stored within the body portion 12 and the hanger 10 inserted entirely within the garment's neck opening. The neck portion 18 is then positioned in the neck opening with the shoulder portions 20 within the shoulder areas. The hook portion 14 is then pivoted upwardly to hang the garment on a rod, door, etc.

Figure 2:
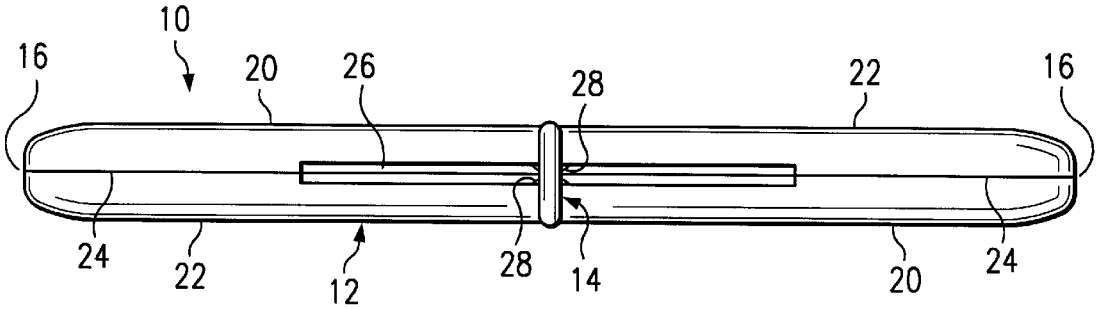
FIG. 2 is a top plan view of the clothes hanger of FIG. 1 after rotation of a hook portion thereof about a vertical axis.

The body portion 12 has two sides 22 which are joined together by a suitable method, preferably adhesive bonding, at peripheral interface surfaces 24. A hook opening 26 is formed when sides 22 are joined, permitting the hook portion 14 to be pivoted downwardly into the body portion 12 between the sides 22 as shown in FIG. 3A. Laterally extending projections 28 releasably secure the hook portion 14 shaft 30 in a vertical position as shown in FIGS. 1 and 2.

On inner side surfaces 32 of the body sides 22, concave spherical depressions 34 are formed. When the body sides 22 are joined together, as described hereinabove, the depressions 34 form therebetween a spherical cavity in which a spherical end 36 of the hook portion 14 is received. By joining the sides 22 together with the spherical end 36 between the depressions 34, the hook portion 14 is pivotably and rotatably attached to the body portion 12.

Figure 3B:
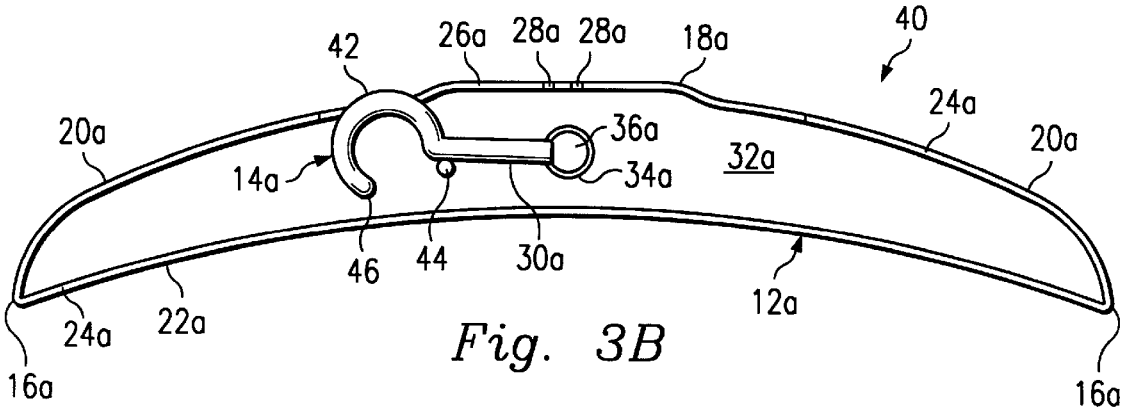
FIG. 3B is a side elevational view of an alternate embodiment of the clothes hanger of FIGS. 1–2, again with a body side removed to reveal the hook portion thereof pivoted about a horizontal axis into a stored position.

Referring additionally now to FIG. 3B, an alternate configuration of the hanger 40 is shown. For convenience, and for clarity of description, those elements of the hanger 10*a* representatively illustrated in FIG. 3B, which are substantially similar to elements representatively illustrated in FIG. 3A, are indicated in FIG. 3B using the same reference numerals as previously used, with an added suffix "a".

Hanger 40 includes a hook portion 14*a* which extends partially outwardly through opening 26*a* when the hook portion is stored within the body portion 12*a*. This feature permits the hook portion 14*a* to be conveniently grasped for extension from the body portion 12*a* when desired.

Hook portion 14*a* may include an enlarged section 42 which has a width greater than a width of the opening 26*a*, thereby preventing the enlarged section from passing through the opening. One or both of the inner side surfaces 32*a* may have a projection 44 formed thereon, which abuts the hook portion 14*a* when it is pivoted downwardly. Tip 46 of the hook portion 14*a* may also be elongated so that it abuts one or both of the body sides 22*a*, thereby preventing the hook portion from pivoting further downwardly into the body portion 12*a*.

Figure 4:
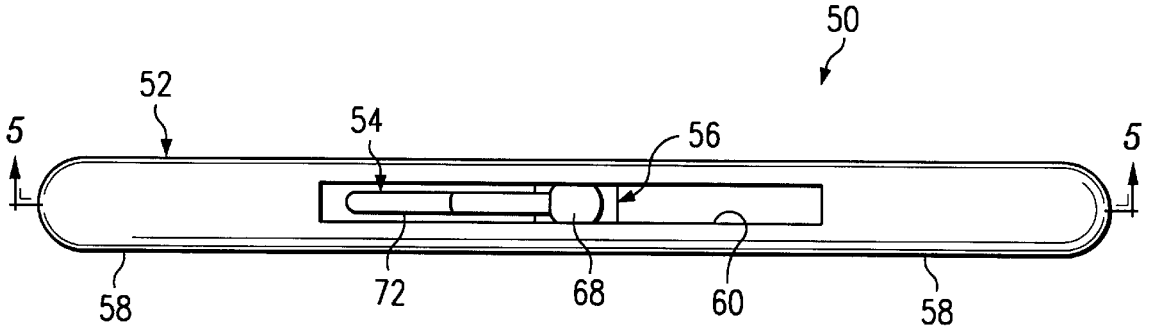
FIG. 4 is a top plan view of another alternate embodiment of a clothes hanger constructed in accordance with the teachings of the present invention.
Figure 5:
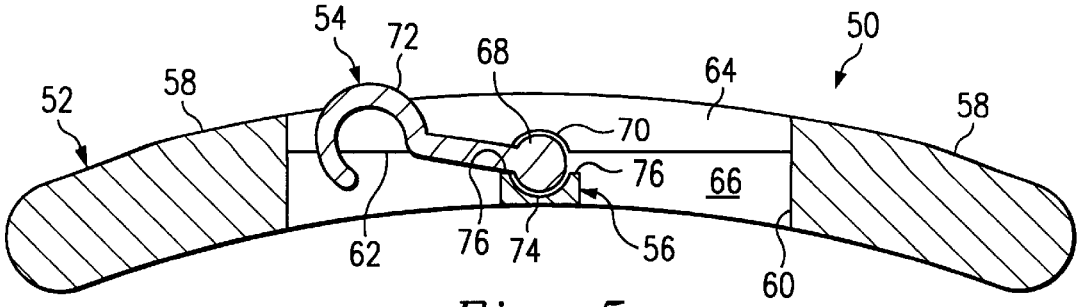
FIG. 5 is a cross-sectional view of the clothes hanger of FIG. 4, taken along line 5—5 thereof.

Turning now to FIGS. 4 and 5, another embodiment of a clothes hanger 50 embodying principles of the present invention is representatively illustrated. FIG. 5 shows a cross-sectional view of the hanger 50, taken through line 4—4 of FIG. 4. Hanger 50 includes a body 52, a hook 54, and a retainer 56.

Body 52 has an elongated downwardly curved shape with laterally extending opposite shoulder portions 58. Laterally intermediate the shoulder portions 58 an inner cavity 60 is formed through the body 52. A step 62 separates an upper, laterally narrowed, portion 64 of the cavity 60 from a lower, laterally widened, portion 66 of the cavity.

The hook 54 is received in the cavity 60 and has a spherical end 68 in cooperative engagement with a complementarily-shaped curved portion 70 formed on the step 62. Spherical end 68 is too large to pass through the narrow portion 64 of the cavity 60, but is received in the widened portion 66. Upper hook portion 72 of the hook 54 may pass through both widened and narrow portions 64 and 66 of the cavity 60.

The retainer 56 is received in the widened portion 66 and disposed such that the spherical portion 68 is intermediate the curved portion 70 of the step 62 and a complementarily-shaped curved portion 74 formed on the retainer. The retainer 56 is secured in place in the cavity 60 with glue or other fastening means. Opposite end portions 76 formed on the retainer 56 prevent the upper hook portion 72 from being downwardly pivoted completely into the cavity 60, so that it may be easily grasped and pivoted upwardly when desired.

The hook 54 may, thus, be pivoted upwardly out of the cavity 60, the spherical end 68 pivoting between the curved portions 70 and 74. The hook 54 may also, when upper hook portion 72 is out of the cavity 60, rotate about a vertical axis, the spherical end 68 rotating between the curved portions 70 and 74.

Referring next to FIGS. 6–11, still another clothes hanger 110 constructed in accordance with the teachings of the present invention may be seen. The clothes hanger 110 includes a body portion 112 and a hook member 114. The hook member 114 is disposed midway between opposite ends 116 of the body portion 112. Similar to the previously described embodiments of the invention, the clothes hanger 110 has a length between the hook member 114 and each opposite end 16 which is not limited by the length of a garment's neck opening.

In a manner similar to the clothes hanger 10, 40 and 50 previously described, the body portion 112 is comprised of a central neck portion 118 and first and second shoulder portions 120*a* and 120*b*. Each of the first and second shoulder portions 120*a* and 120*b* has a roughly cylindrical shape which gradually curves as it extends outwardly and downwardly relative to the central neck portion 118. In this manner, the body portion 112 collectively enjoys a concavely downwardly opening curved shape. When operatively installed into a garment (not shown), the central neck portion 118 will extend upwardly through the garment's neck opening and the first and second shoulder portions 120*a* and 120*b* will extend into the shoulder areas of the garment.

Figure 6:
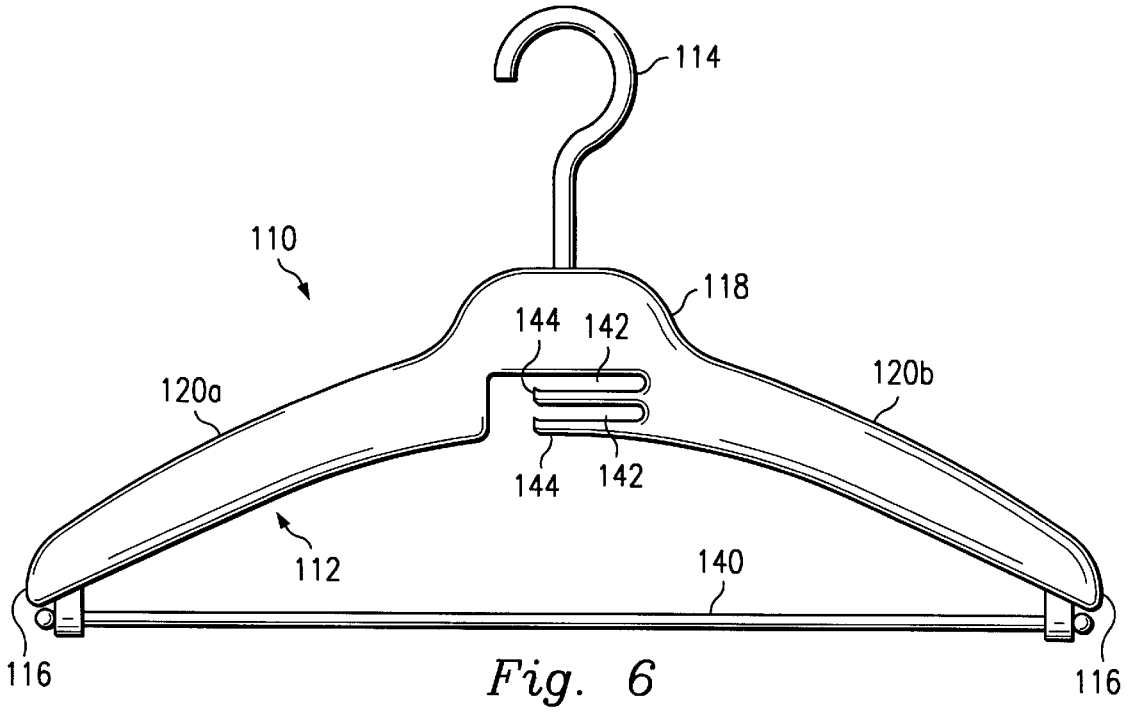
FIG. 6 is a side elevational view of still another alternate embodiment of a clothes hanger constructed in accordance with the teachings of the present invention.
Figure 7:
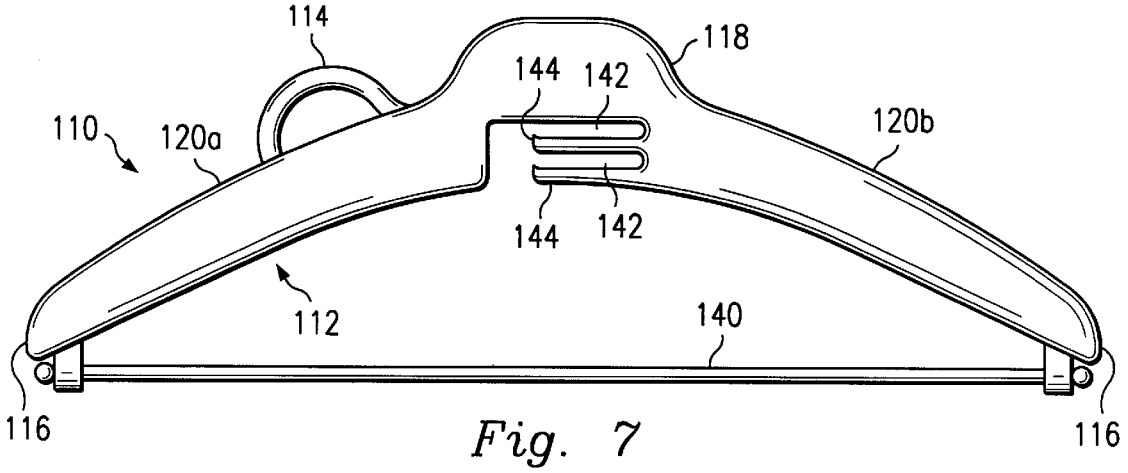
FIG. 7 is a second side elevational view of the clothes hanger of FIG. 6 with a hook portion thereof pivoted about a horizontal axis into a stored position.

As before, the first and second shoulder portions 120*a* and 120*b* are relatively long, thereby providing a larger supporting area on which to suspend the garment. The lengths of the first and second shoulder portions 120*a* and 120*b* are not limited by the size of the garment's neck opening due to the unique manner in which the hook member 114 may be pivoted and stored, as shown in FIGS. 7 and 9, within a space defined by interior side surfaces of side walls of the body portion 112. After storing the hook member 114 within the body portion 112, the clothes hanger 110 can be inserted entirely within the garment's neck opening. The central neck portion 118 is then positioned in the neck opening with the first and second shoulder portions 120*a* and 120*b* within the respective shoulder areas of the garment. The hook member 114 is then pivoted upwardly to hang the garment on a rod, door, etc. It should be noted that, in the embodiment of the invention illustrated in FIGS. 6–11, as the hook member 114 is pivoted into the interior of the body portion 112, insertion of the hook member 114 is limited by engagement of the hook member 114 with a bottom wall of the body portion 112 (see FIG. 9). Thus, part of the hook member 114 remains outside of the body portion 112. However, as the height of the clothes hanger 110 has been reduced substantially, insertion of the clothes hanger 110 within the garment's neck opening is still greatly facilitated. Furthermore, it should be noted that full insertion of the hook member 114 within the interior of the body portion 112 is possible by minor modification of the clothes hanger 110, for example, by increasing the separation between top and bottom walls of the first and second shoulder portions 120*a* and 120*b*.

The clothes hanger 110 includes several additional features not incorporated in the clothes hangers 10, 40 and 50, each of which are considered to further enhance the usefulness of the clothes hanger 110. More specifically, positioned below the body portion 112 and attached to both ends 116 is a horizontal bar 140. It is contemplated that additional clothes may be hung on the horizontal bar 140. For example, if a jacket or sweater is hung on the body portion 112, a coordinated article of clothing, for example, a pair of pants may be hung on the horizontal bar 140. While the embodiment of the invention illustrated herein discloses a single horizontal bar 140 on which additional articles of clothing may be supported, it should be clearly understood that other configurations, for example, a dual horizontal bar configuration where the article of clothing is tightly held therebetween are equally suitable for the uses contemplated herein. Additionally, formed in a lower end of the neck portion 118 are horizontal slots 142. It is contemplated that additional articles of clothing, for example, ties, may be inserted into the horizontal slots 142 where they are supported by horizontal members 144. It should be understood, however, that the present disclosure of two horizontal members 144 on which additional article of clothing may be supported is purely exemplary and that other numbers of horizontal members may be equally suitable for the uses contemplated herein.

Figure 8:
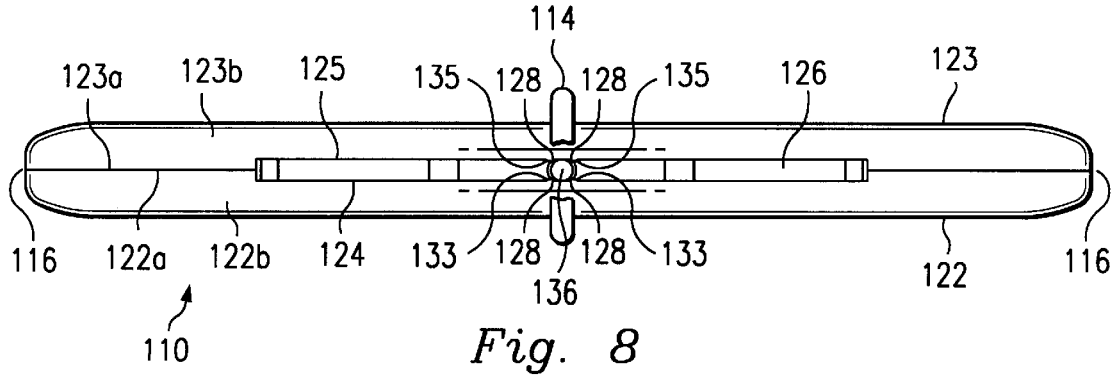
FIG. 8 is a top plan view of the clothes hanger of FIG. 6 after rotation of the partially broken away hook portion thereof about a vertical axis.
Figure 9:
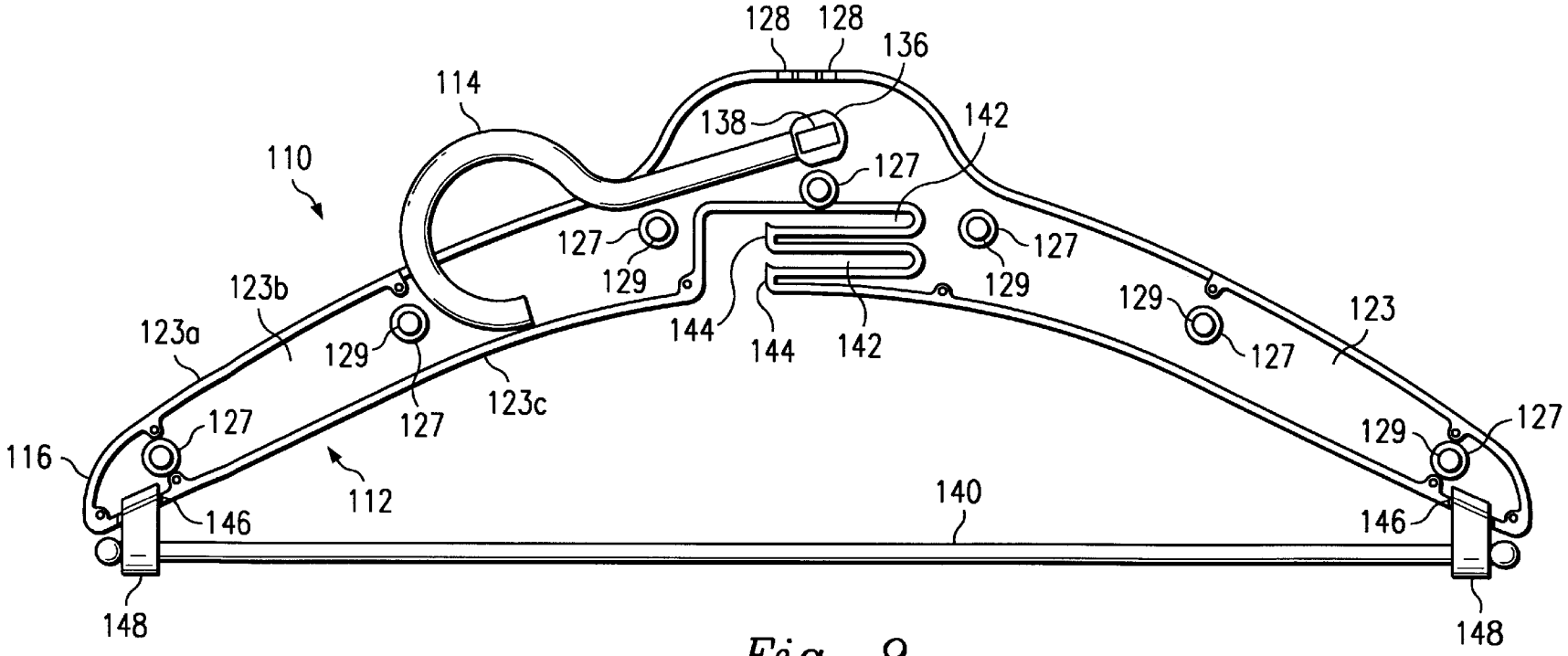
FIG. 9 is a side elevational view of the clothes hanger of FIGS. 6–8, with a body side removed to reveal the hook portion thereof, again pivoted about the horizontal axis into the stored position.
Figure 10:
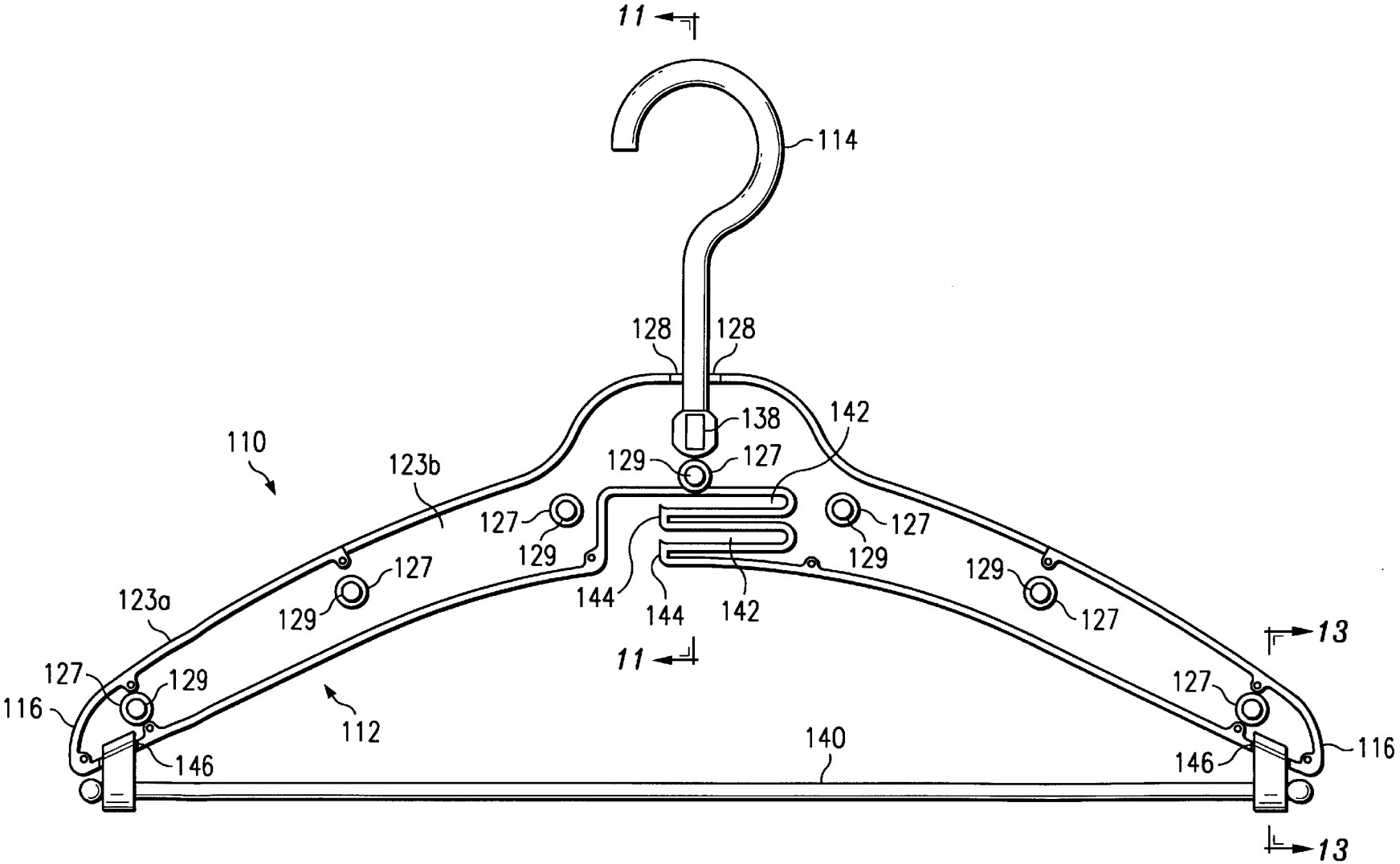
FIG. 10 is a second side elevational view of the clothes hanger of FIGS. 6–8, again with a body side removed to reveal the hook portion thereof, pivoted about the horizontal axis back into the extended position.

As may be best seen in FIGS. 8–9, the body portion 112 is comprised of first and second sides 122 and 123. Each side 122, 123 extends from a top peripheral edge side surface, for example, top peripheral edge side surface 123*a*, to a bottom peripheral edge side surface, for example, bottom peripheral edge side surface 123*b*. In the shoulder portions 120*a*, 120*b*, the sides 122 and 123 are roughly semi-cylindrical in shape. Accordingly, when the first and second sides 122 and 123 are joined together at the peripheral edge side surfaces thereof, for example, by way of an adhesive bonding method, an interior space 126 capable of receiving the hook member 114 is defined. Further, as the top peripheral edge side surfaces 122*a*, 123*a* extend inwardly to interior top peripheral edge side surfaces 124, 125, respectively, an access aperture, defined by the interior top peripheral edge side surfaces 124, 125, to the interior space 126 is provided. Thus, when pivoting the hook member 114 downwardly, it passes through the access aperture and into the interior space 126. Conversely, when pivoting the hook member 114 upwardly, laterally extending projections 128 releasably secure a shaft portion 130 of the hook member 114 in an upright position as shown in FIGS. 6, 8 and 10.

Formed along an interior side surface of the side 123 are a series of tubular projections 127, i.e., a generally cylindrical projection having a hollowed out interior portion. A corresponding series of generally cylindrical solid projections 131 are formed along an interior side surface of the side 122. As the solid projections 131 are of slightly reduced diameter relative to the hollowed-out tubular projections 127, when the first and second sides 122 and 123 are mounted together, the solid projections 131 are insertably received within the hollowed-out portions 129 of the tubular projections 127 to form structural support beams for the body portion 112.

Also formed along the interior side surfaces of the first and second sides 122 and 123, respectively, and projecting outwardly therefrom in the same direction as the projections 127 and 131, are a pair of additional tubular projections which respectively function as seats 133 and 135. Similar in configuration to the projections 127, each seat 133, 135 is comprised of a generally cylindrical wall which surrounds a hollowed out interior. When the first and second sides 122 and 123 are joined together, as described hereinabove, the seats 133 and 135 captively retain a spherical end 136 of the hook member 114 therebetween. By joining the first and second sides 122 and 123 together with the spherical end 136 captively retained between the seats 133, 135, the hook member 114 is pivotably and rotatably attached to the body portion 112.

Preferably, the diameter of the projecting cylindrical walls which respectively form the seats 133, 135 are both slightly less than the diameter of the spherical end 136 of the hook member 114. This enable the spherical end to both upwardly and downwardly pivot along the vertical axis, i.e., pivot between the upright and retracted positions respectively illustrated in FIGS. 6 and 7, as well as rotate 360 degrees along the horizontal axis. For example, FIGS. 8 and 9 shows the hook member 114 rotated 90 degrees apart. Finally, in the embodiment of the invention disclosed herein, a pair of vertical slots 138, spaced 180 degrees apart, are formed on the spherical end 136. The vertical slots 138 are provided to reduce the amount of material needed to form the spherical end 136 as well as quicken cooling of the spherical end 136, when formed of a molded plastic material. It should be clearly understood, however, that the spherical end 136 will both pivot and rotate equally well without any slots formed therein (see, for example, FIGS. 1–5) or with greater numbers of narrower slots formed therein.

Figure 13:
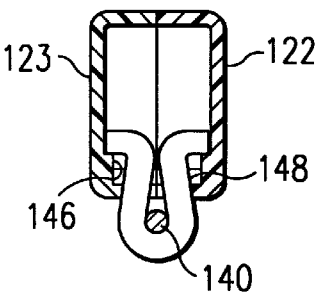
FIG. 13 is a cross-sectional view of the clothes hanger of FIGS. 6–12, taken along line 13—13 of FIG. 10.
Figure 12:
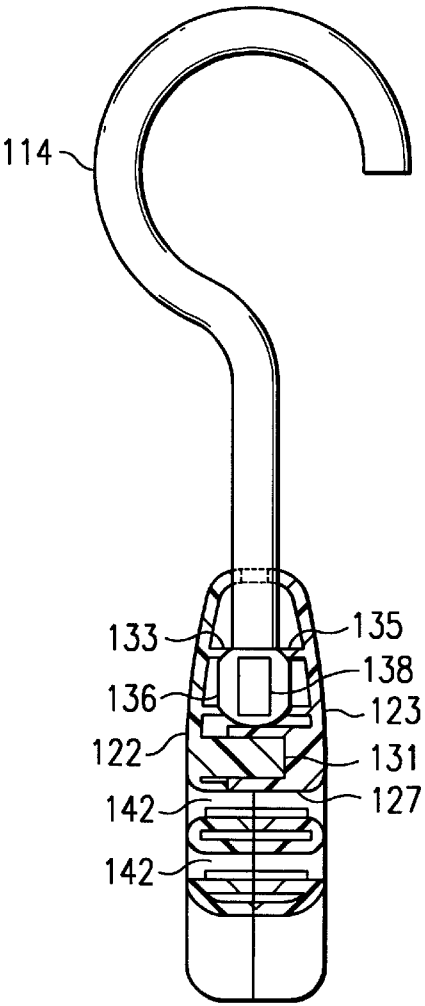
FIG. 12 is a second cross-sectional view of the clothes hanger of FIGS. 6–10, again taken along line 11–11 of FIG. 10, after pivoting the hook portion thereof along the vertical axis.
Figure 11:
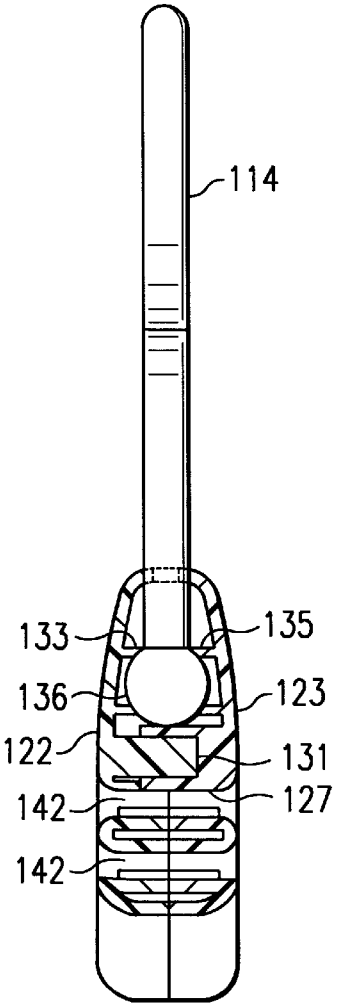
FIG. 11 is a cross-sectional view of the clothes hanger of FIGS. 6–10, taken along line 11—11 of FIG. 10.

Referring next to FIG. 13, the attachment of the horizontal bar 140 to the ends 116 of the body portion 112 will now be described in greater detail. As may now be seen, when the first and second sides 122 and 123 are mounted together, an aperture 146 which extends into the interior thereof is formed on each end 116 of the body portion 112, typically, by exposing an interior bottom peripheral edge side surface of a bottom peripheral edge side surface, for example, bottom peripheral edge side surface 123*b* before attaching the first and second sides 122 and 123 together. Bayonets 148 are insertably mounted in the apertures 146 to mount the horizontal bar 140 below the main body portion 112. Preferably, the bayonets are compressible so that the horizontal bar 140 may be readily attached to and/or detached from the main body portion 112 as needed. The horizontal slots 142 and corresponding horizontal members 144, on the other hand, are formed by shaping the neck portion of the bottom peripheral edge side surface of the first and second sides 122 and 123, for example, the bottom peripheral edge side surface 123*b* in the illustrated pattern.

Finally, it should be noted that each of the above-described elements of the clothes hangers 10, 40, 50 and 100 herein described may be made of a suitable molded plastic material. However, other materials may be used without departing from the principles of the present invention.

Thus, there has been described and illustrated herein, a clothes hanger having a hook member pivotable between upright and retracted positions and rotatable 360 degrees in which a spherical end portion thereof is captively retained between a pair of seats formed on inner side surfaces of first and second sides thereof. However, those skilled in the art will recognize that numerous modifications and variations from that specifically disclosed herein are possible without substantially departing from the scope of the present invention. It should be clearly understood, therefore, that the embodiment of the invention disclosed herein is considered to be exemplary only and should not be construed as limiting the invention, which is defined only by the claims appended hereto.

What is claimed is:

1. A clothes hanger, comprising:

a hook portion having a hook, a generally spherical end, and a shaft extending between said hook and said spherical end;

a body portion including first and second sides, each of said first and second sides having an inner side surface, said inner side surfaces defining an interior space; and first and second projections which respectively extend from said inner side surface of said first and second sides and into said interior space;

said first and second sides being joined together such that said spherical end is captively retained between said first and second projections, said hook portion is rotatable about a vertical axis and pivotable about a horizontal axis relative to said body portion, and an opening capable of receiving said hook portion therein is formed between said first and second sides such that said hook portion is storable in said opening.

2. A clothes hanger according to claim 1, further comprising inwardly extending projections formed on said sides adjacent said opening, said projections releasably securing said shaft aligned with the vertical axis.

3. A clothes hanger according to claim 1, wherein said body portion further includes a neck portion and two opposing shoulder portions extending outwardly from said neck portion, said neck portion being disposed intermediate said shoulder portions.

4. A clothes hanger according to claim 1, wherein said body portion is a hollow, generally cylindrical member having a downwardly concave curved shape.

5. A clothes hanger according to claim 1, wherein each of said first and second projections is a generally cylindrical wall which encloses an interior space.

6. A clothes hanger according to claim 1 wherein each of said first and second projections is a generally cylindrical wall having a top side surface and enclosing an interior space, said top side surface of said each of said generally cylindrical walls slidingly engaging said generally spherical end of said hook portion when said first and second sides are joined together.

7. A clothes hanger according to claim 6 wherein:

said generally cylindrical wall of each of said first and second projections has a first diameter and said generally spherical end of said hook portion has a second diameter, said first diameter being slightly less than said second diameter.

8. A clothes hanger, comprising:

a hook portion having a hook, a generally spherical end, and a shaft extending between said hook and said generally spherical end;

a body portion including first and second sides, each of said first and second sides having an inner side surface; and first and second projections which respectively extend from said inner side surface of said first and second sides and into an interior space;

said first and second sides of said body portion being joined together such that:

a) said inner side surfaces of said first and second sides of said body portion defying the interior space;

b) said generally spherical end of said hook portion is captively retained, within said interior space, between said first and second projections;

c) said first and second sides of said body portion defining an opening capable of receiving said hook portion therein such that said hook portion may extend through said opening for storage in said interior space;

said hook portion being pivotable between upright and retracted positions and rotatable 360 degrees around.

9. A clothes hanger according to claim 8, wherein each of said first and second projections is a generally cylindrical wall which encloses an interior space.

10. A clothes hanger according to claim 8 wherein each of said first and second projections is a generally cylindrical wall having a top side surface and enclosing an interior space, said top side surface of said each of said generally cylindrical walls slidingly engaging said generally spherical end of said hook portion when said first and second sides are joined together.

11. A clothes hanger according to claim 10 wherein said generally spherical end of said hook portion is seated between, and captively retained by, said top side surface of said generally cylindrical wall of said first projection and said top side surface of said generally cylindrical wall of said second projection.

12. A clothes hanger according to claim 11 wherein:

said generally cylindrical wall of each of said first and second projections has a first diameter and said generally spherical end of said hook portion has a second diameter, said first diameter being slightly less than said second diameter.

13. A clothes hanger according to claim 10 wherein said top side surface of said generally cylindrical wall of said first projection forms a first seat and said top side surface of said generally cylindrical wall of said second projection forms a second seat, said generally spherical end of said hook portion being captively retained between said first and second seats when said first and second sides of said body portion are joined together.

14. A clothes hanger according to claim 13 wherein:

said generally cylindrical wall of each of said first and second projections has a first diameter and said generally spherical end of said hook portion has a second diameter, said first diameter being slightly less than said second diameter.

15. A clothes hanger according to claim 8 wherein said body portion further comprises first and second ends and wherein said clothes hanger further comprises a bar attached to said first and second ends of said body portion.

16. A clothes hanger according to claim 15 wherein first and second apertures are formed when said first and second sides of said body portion are joined together and where said bar further comprises first and second bayonets, each insertable into said first and second apertures, respectively, to releasably engage said bar with said body portion.

17. A clothes hanger according to claim 10 wherein each one of said first and second sides are formed in a generally semi-cylindrical shape.

18. A clothes hanger according to claim 17 and further comprising at least one structural support beam which extends from said inner side surface of said first side of said body portion to said inner side surface of said second side of said body portion.

19. A clothes hanger according to claim 18 wherein each one of said at least one structural support beam is comprised of a projection which extends from said inner side surface of said first side of said body portion and into said interior space and a tubular projection which extends from said inner side surface of said second side of said body portion and into said interior space, said projection extending from said inner side surface of said first side of said body portion being received in an interior space defined by said tubular projection when said first and second sides of said body portion are joined together.

20. A clothes hanger according to claim 10 wherein each one of said first and second sides further comprises a lower side surface having at least one horizontal slot formed therein and wherein a horizontal member is formed for each of said at least one horizontal slot when said first and second sides of said body portion are joined together.

* * * * *